US006866267B1

(12) United States Patent
Hesse

(10) Patent No.: US 6,866,267 B1
(45) Date of Patent: Mar. 15, 2005

(54) CARD GAME

(75) Inventor: Michael A. Hesse, Westlake Village, CA (US)

(73) Assignee: Helix Information Services, Inc., Westlake Village, CA (US)

( * ) Notice: Subject to any disclaimer, the term of this patent is extended or adjusted under 35 U.S.C. 154(b) by 0 days.

(21) Appl. No.: 10/647,138

(22) Filed: Aug. 22, 2003

Related U.S. Application Data

(60) Provisional application No. 60/407,161, filed on Aug. 29, 2002.

(51) Int. Cl.[7] ..... A63F 1/00
(52) U.S. Cl. ..... 273/292
(58) Field of Search ..... 273/292, 303; 463/12

(56) References Cited

U.S. PATENT DOCUMENTS 5,280,915 A * 1/1994 Groussman ..... 273/292
5,415,414 A * 5/1995 Savage ..... 273/306
5,538,252 A * 7/1996 Green ..... 273/306
5,577,731 A * 11/1996 Jones ..... 273/292
5,735,524 A * 4/1998 Wisted ..... 273/274
6,019,373 A * 2/2000 Brown ..... 273/274
6,523,831 B2 * 2/2003 Webb ..... 273/292
6,634,645 B1 * 10/2003 Yuan ..... 273/292
6,692,003 B2 * 2/2004 Potter et al. ..... 273/274

* cited by examiner

*Primary Examiner*—Kurt Fernstrom
(74) *Attorney, Agent, or Firm*—Sierra Patent Group, Ltd.

(57) ABSTRACT

A card game called "Blackjack Gold" is disclosed. Blackjack Gold is a variation of blackjack in which the game is played to 21, the game is played with a rotating "Dealer", there are no jokers in the deck, a less frequent of combination of cards than an ace and an a ten-value card qualifies as a Natural, and players whose hand exceeds 21 do not always lose.

18 Claims, 3 Drawing Sheets

CARD GAME

PRIORITY STATEMENT

This application claims priority to a Provisional Application having Ser. No. 60/407,161, filed on Aug. 29, 2002, and entitled "Card Game".

BACKGROUND

The present disclosure relates to gaming and to card games, and more particularly, to a card game in which a number of players play against one another or against a casino or card room.

Numerous card games are known in the prior art. One of the most popular card games is blackjack. There are three wagering formats common in card games involving wagering. The first is wagering against the casino (the Nevada model). The second format is wagering against the other players for: a common pool (the Poker model). The third format is wagering against a designated player (the California model).

In states where there is casino gambling, most wagering is against the casino. In blackjack, for example, each player is dealt a hand, and a hand is dealt for the casino. If the player loses, the casino collects the money. If the player wins, the casino pays the player. The casino makes money when the players lose more than they win. This type of wagering is currently illegal in states such as California, due to a statutory prohibition of "banking" games. Under present California law, the gaming establishment can hold no interest in the outcome of a wager.

In poker and poker-type games, the players do not wager against the house. The players are playing against each other. All the wagers are placed in a common pool (the pot), and the player with the best hand wins all the money wagered on the deal. In poker-type games, the gaming establishment makes money by taking a "Collection." This is a fee collected by the gaming establishment either for each hand or for each half-hour of play. In Nevada, the collection may be a fixed amount or a percentage of the pool. In California, the collection must be a fixed amount (except for pari-mutual horse racing). A typical collection would be about $1 for each hand, charged to each player. A typical time collection might be about $8 per half hour for a poker game where the bets and raises are limited to about $30. This form of wagering is mostly used for poker and pan (a form of rummy).

Pai Gow, a Chinese wagering game played with tiles, introduced a new wagering model to California card rooms. However, this model is familiar to anyone who has played blackjack with friends rather than in a casino. It is something of a hybrid between the California and Poker models. For each hand, one of the players is designated the "Dealer," and all the other players are trying to beat the Dealer. If the player beats the Dealer, the player wins and is paid off from the Dealer's wager. If the Dealer has a better hand than the player, the Dealer wins the player's wager.

Each player has the option to play the role of Dealer. Typically, a player is the Dealer for two hands. Then, the option is offered to the next player on the left to become Dealer, or pass the option on to the next player. There are other equivalent ways to handle the Dealer option with respect to the direction of pass (i.e., rotate to the right, etc.) and duration of Dealer status (i.e., one, three, or more hands).

The Dealer is not bound by any table limit. The Dealer frequently bets enough to cover the bets of all the players at the table. However, the Dealer is not required to make any bet other than the table minimum.

On every hand, dice are shaken and the order of payoffs is determined. This decides how the wagers are settled if the Dealer is not wagering enough money to cover all the bets made by the other player. An alternative method is to always start payoffs with the player on the Dealer's left.

The Dealer does not actually deal the cards or settle the wagers the way a Nevada blackjack dealer would. These functions are handled by a gaming establishment employee commonly called the "House Dealer." Throughout this document, the term "Dealer" will refer to the player against whom the other players are wagering. The term "House Dealer" will refer to the gaming establishment employee who actually deals the cards and runs the game.

Blackjack is illegal in California. However, a number of games that resemble blackjack have been invented that have been found to be legal in California. All of these games fall into one of two categories: 1) The games play to a target of 22 instead of 21; or 2) The games introduce jokers into the deck. Some games are a combination of these two types of games. In addition, the games typically introduce complex methods of deciding who wins when the player exceeds the target.

To be successful in the California market, games must not only be legal, but there must also be a significant advantage for the dealer. Under the "California Wagering Model", players are offered the option to act as the Dealer and other players compete against this Dealer. The house cannot play this role under California law and no single player can act as the Dealer for many consecutive hands. In order for a game to proceed, at least two players at the table must take the option to be the Dealer. To encourage this, successful California games typically have an advantage for the Dealer of about 1% to about 2%. This is significantly larger than the house advantage in conventional blackjack.

SUMMARY

According to a preferred embodiment, a card game "Blackjack Gold" is disclosed. Blackjack Gold is a game of skill and is played with one to eight normal decks of playing cards, although more decks may be employed. It is a modified version of blackjack.

In blackjack, an ace and any ten-value card on the first two cards: is a "blackjack." It is an automatic winner and pays about $3 for every $2 wagered. It occurs once every about 4.83% to about 4.74% of the time depending on the number of decks.

In Blackjack Gold, the "Natural" is a less frequent combination of cards, such as two aces of the same suit, two aces of the same color, an ace and a jack, an ace and a jack of the same suit, or an ace and a jack of the same color. It may be paid $3 for every $2 wagered, $2 for every $1 wagered, or a similar bonus.

There are other similar card combinations. The key is that the combinations are less frequent than a blackjack Natural. For example, two aces of the same suit will occur about 0.07% and about 0.13% depending on the number of decks. Or an ace jack occurs about 1.19% to about 1.21% of the time, depending on the number of decks.

While decreasing the number of Naturals accomplishes the goal of increasing the advantage for the "Dealer", it often increases it too much. To offset this, Blackjack Gold introduces a second new feature. Players who go over 21 (i.e., getting a "bust") do not always lose. The player may (depending on the variation) tie the "Dealer" or even win.

In the preferred embodiment of Blackjack Gold, the player wagers against a designated player "Dealer." The designated Dealer is rotated throughout the game. The house collects a fixed amount from each player for each hand. However, Blackjack Gold could also be played using the Nevada wagering model, where players play against the casino.

While many of these innovations have been seen in other games, Blackjack Gold introduces a unique combination: 1) a game played to 21; 2) a game played with a rotating "Dealer"; 3) a game with no jokers; 4) a game with a different Natural; and 5) a game where players who go over 21 do not always lose.

BRIEF DESCRIPTION OF THE FIGURES

Referring now to the figures, wherein like elements are numbered alike.

DETAILED DESCRIPTION

Figure 1:
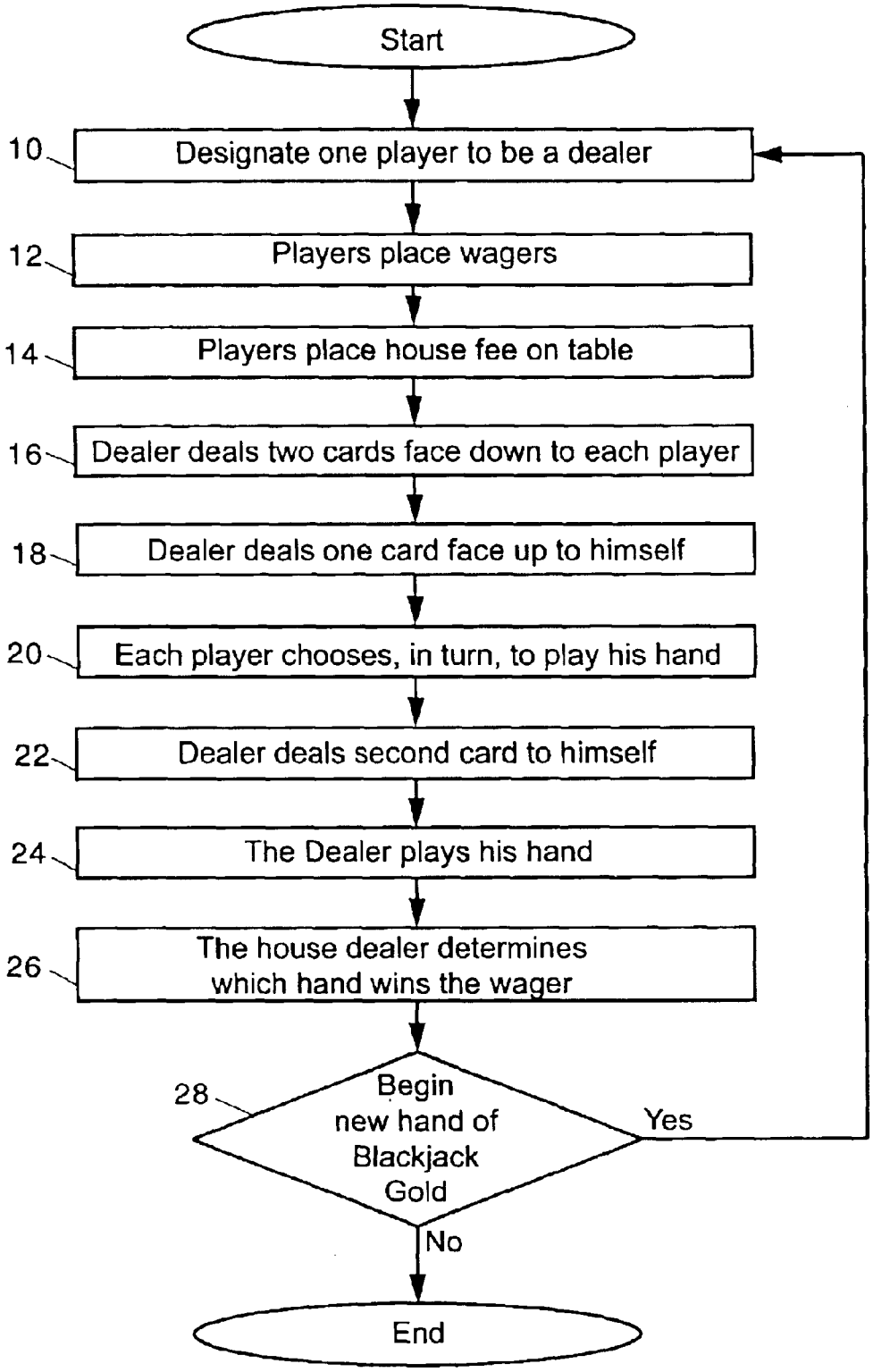
FIG. 1 is a flow chart of the method of playing Blackjack Gold.

Those of ordinary skill in the art will realize that the following description of the present invention is illustrative only and not in any way limiting. Other embodiments of the invention will readily suggest themselves to such skilled person.

The game of Blackjack Gold is played with one or more decks of playing cards with no jokers. According to a preferred embodiment of the game, two to six decks are used, although it will be readily recognized that other numbers of decks could be employed.

In the preferred embodiment of the game of Blackjack Gold, players play against each other rather than against a casino or card room. Hence, the game is not a banking game that is specifically prohibited in states such as California. One player is designated as "Dealer" for each hand. However, Blackjack Gold could also be played using the Nevada wagering model, where players play against the casino.

The object of the game is for the player to beat the Dealer or the Dealer to beat the Player. The player wins by getting a hand with a higher numerical value of 21 or less or, in a preferred embodiment, by getting a numerical value over 21 that is the same as the Dealer's. The Dealer wins by getting a hand under 21 with a higher numerical value than the player's, or if the player goes over 21 and does not tie the dealer.

Those of ordinary skill in the art will recognize that other combinations are possible that remain within the spirit and scope of the present disclosure. For example, if a player goes over 21 and ties the Dealer this could be considered a "push" and the player would receive his/her wager back. Another option is that if the player and Dealer go over 21 and the player's total is exactly one less than the Dealer's total, the player would win. Another possible option is the player wins or ties on the specific total over 21, with the Dealer winning on other specific totals over 21.

Each hand's value is a found by adding the values of the cards in the hand. As in conventional blackjack, an ace is worth one or eleven, face cards are worth ten and all other cards have their face value.

As in conventional blackjack, the player has several options; to hit, stand, split a pair, double down (double the bet on the first two cards and receive exactly one more card), surrender (give up one-half of the bet after seeing the fist two cards and keep the other half of the bet) or take insurance (make a side wager as to whether the dealer has a Natural). There are many variations of these wagers being used at casinos all over the world. Blackjack Gold could easily be played with most of these rule variations.

In Blackjack Gold, the players wager against a player designated as the "Dealer." Each player has the option to play the role of Dealer. Typically, a player is Dealer for two hands. Then the option is offered to the next player on the left who can become the Dealer or pass the option on to the next player. There are other methods of handling the Dealer option with respect to the direction of pass (i.e., rotate to the right, etc.) and the duration of Dealer status (i.e., three or more hands or until the next time the cards are shuffled).

Blackjack Gold is designed to give an advantage to the Dealer with perfect play by all the players. The size of the advantage depends on the house rules. This is important, since there cannot be a game unless someone is willing to be Dealer.

In a preferred embodiment, Blackjack Gold places no restrictions on the Dealer's play. Optionally, the Dealer's play may be restricted or totally fixed by restrictions on when the Dealer may hit or stand.

The casino or card room may collect a fixed amount from each player for each hand. The winner is determined by comparing the Dealer's hand value to the player's hand value. If both hands are under 21, the higher hand wins. If one of the Dealer, or the player's hand goes over 21 and the other does not, the party having the hand under 21 wins. If both parties hands are over 21, the Dealer wins except for the special case specified by the rules. In one preferred embodiment, the special case is when the player's and the Dealer's hand tie at a number over 21. In this case, the player wins. In another preferred embodiment, the hand is a push and the player's bet is returned to the player. In another preferred embodiment, the player wins when his hand is exactly one point less than the Dealer's hand. There are many other such special rules possible to balance the game properly between the Dealer and the players.

According to a preferred embodiment, there is a hand designated as a "Natural." This hand occurs less frequently than the "Natural" in blackjack. In a preferred embodiment, the Natural hand is an ace and jack of the same suit. Other possible "Natural" hands include an ace and a jack of the same color, two aces of the same suit, and two aces of the same color, as well as many other hands that occur with similar frequency. In a preferred embodiment, these hands play $2 for every $1 wagered, although these hands could pay different amounts, such as $3 for every $1 or $3 for every $2. A Natural only occurs on the first two cards dealt in a hand and a Natural beats any hand except another Natural hand.

Figure 2:
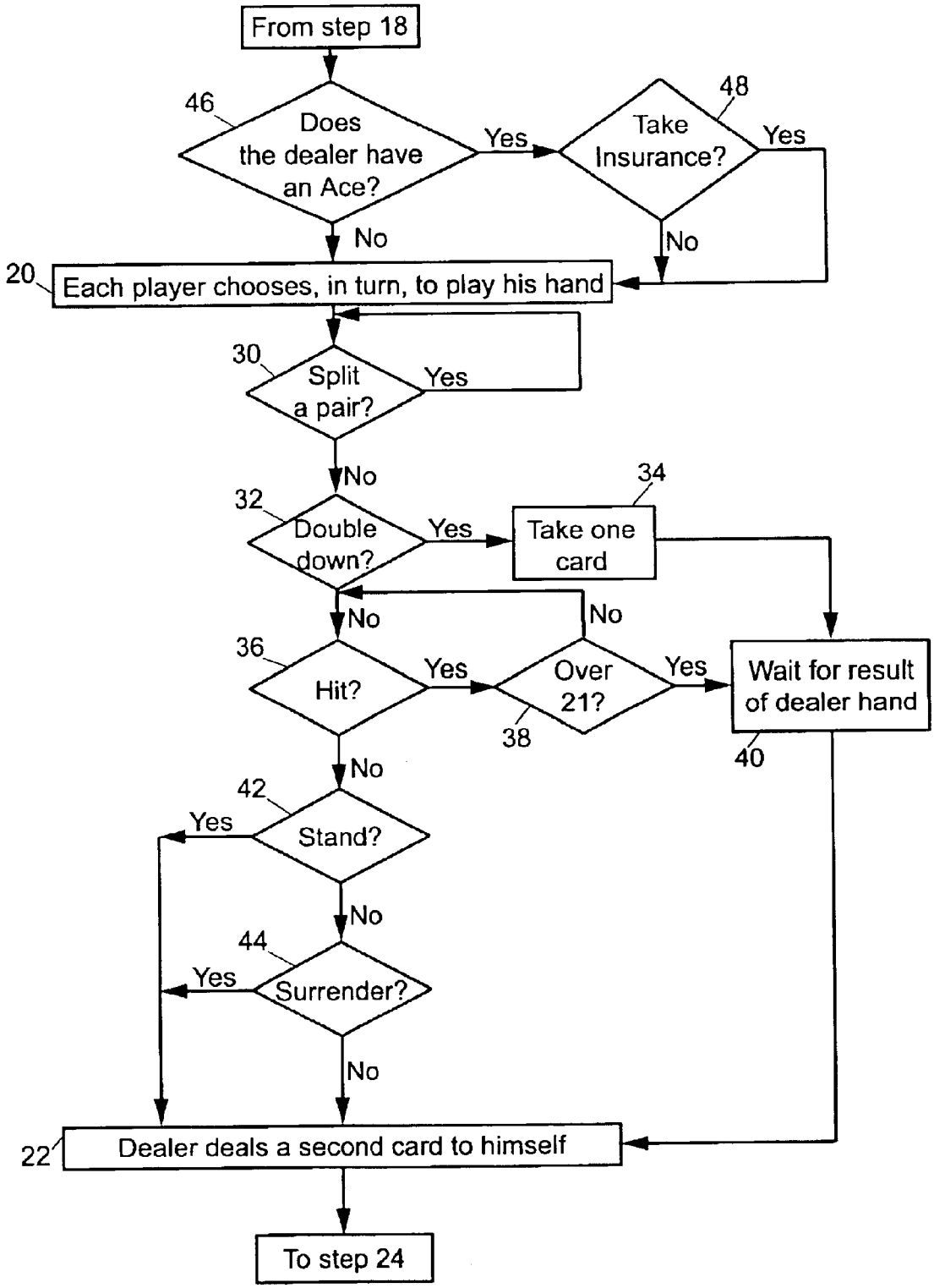
FIG. 2 is another flow chart of the method of playing Blackjack Gold.
Figure 3:
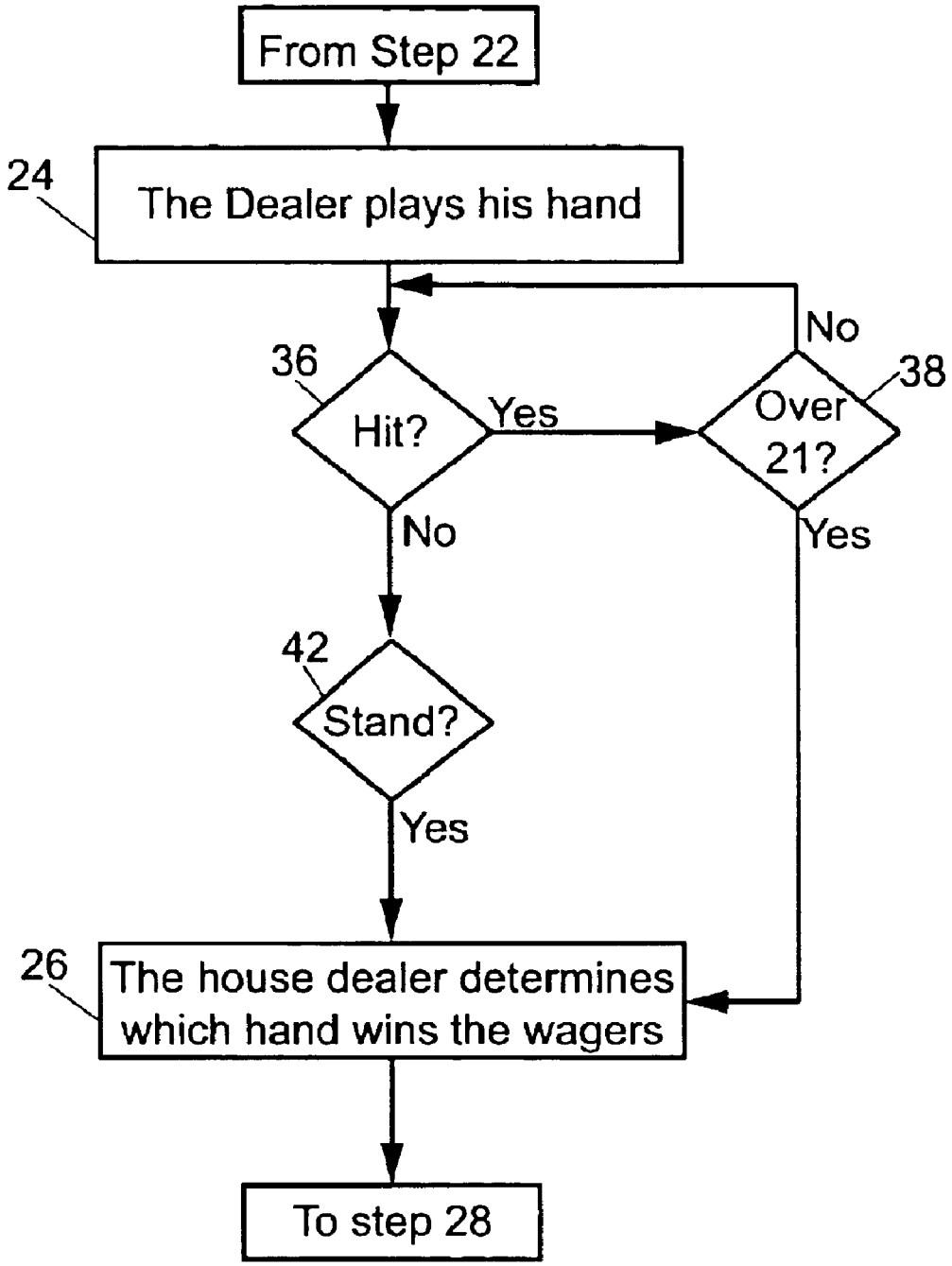
FIG. 3 is another flow chart of the method of playing Blackjack Gold.

In a preferred embodiment, play of Blackjack Gold proceeds as illustrated in FIGS. 1, 2, and 3 and described as follows:

1. One player is designated as Dealer for this hand. (Step 10)
2. Each player places his/her bet (or wager). (Step 12)
3. Each player places the house fee on the table (or playing space). (Step 14)
4. Each player is dealt two cards that are face down on the table. (Step 16)

5. The Dealer is dealt one card that is face up on the table. (Step 18)
6. Each player, in turn, chooses to play his/her hand (Step 20) selecting from the following options (these options are the same as in conventional blackjack):
   a. Hit (Step 30);
   b. Stand (Step 32);
   c. Split a Pair (Step 34), if a player splits a pair, the player completes play on each hand created in sequence;
   d. Double Down (Step 36); or
   e. Surrender (Step 38);
   f. Take Insurance (Step 40); and
   g. Bust (Step 42), if the player's hand totals over 21, then the result depends upon the Dealer's hand. (Step 44)
7. A second card is dealt face down to the Dealer. (Step 22)
8. The Dealer plays his/her hand (Step 24) by choosing a hit (Step 30) until the Dealer chooses to stand (Step 32) or the Dealer's hand totals over 21 (i.e., a bust). (Step 42)
9. Based on the results of the player's hands, the House Dealer determines whether each hand wins or loses to the Dealer, and settles the wagers to the extent that the Dealer's money covers the bets. (Step 26)
10. The players can then choose to begin a new hand of Blackjack Gold. (Step 28)

Some gaming establishments may choose to limit the players' and the Dealer's options. The gaming establishments may allow hitting or standing only on hands of certain value or hands of a certain value with a specified number of cards. Other gaming establishments may allow the player to make their decisions freely. All of these options are contemplated in the game Blackjack Gold.

While embodiments and applications of this invention have been shown and described, it would be apparent to those skilled in the art that many more modifications than mentioned above are possible without departing from the inventive concepts herein. The invention, therefore, in not to be restricted except in the spirit of the appended claims.

What is claimed is:

1. A method of playing a blackjack-like, wagering card game with a Dealer and at least one player comprising:

using at least one deck of standard playing cards having no jokers;

dealing a hand of two cards to the Dealer and to each player who has made a wager;

dealing one of said cards of the Dealer face up;

establishing numerical values for each of said cards in said deck of standard playing cards;

assigning values to each said hand by adding up said values of said cards in each said hand;

allowing each said player to reach a total of as close to 21 as possible without exceeding 21 with standard blackjack options selected from the group consisting of hit, stand, split a pair, double down, and surrender;

allowing the Dealer standard blackjack options selected from the group consisting of hit and stand after play is completed by all the players; and establishing a best hand called a Natural that beats all other hands and pays a bonus when it wins;

wherein said Natural is a hand that occurs less frequently than a standard blackjack which is a hand including both an ace of any suit and a card of any suit having a value of ten;

wherein any of said hands of the players that exceed 21 do not always lose responsive to said hands of said player being compared to said of said dealer.

2. The method of claim 1, wherein at least one of the players acts as the Dealer.

3. The method of claim 1, wherein said Natural is two aces.

4. The method of claim 3, wherein said two aces are of the same suit.

5. The method of claim 3, wherein said two aces are of the same color.

6. The method of claim 1, wherein said Natural is an ace and a jack.

7. The method of claim 6, wherein said ace and said jack are of the same color.

8. The method of claim 6, wherein said ace and said jack are of the same suit.

9. The method of claim 1, wherein the player who exceeds 21 and ties the Dealer wins the amount of the player's wager.

10. The method of claim 1, wherein the player who exceeds 21 and ties the Dealer receives back the player's wager.

11. The method of claim 1, wherein a casino acts as the Dealer.

12. The method of claim 11, wherein said Natural is two aces.

13. The method of claim 12, wherein said two aces are of the same suit.

14. The method of claim 12, wherein said two aces are of the same color.

15. The method of claim 11, wherein said Natural is an ace and a jack.

16. The method of claim 15, wherein said ace and said jack are of the same color.

17. The method of claim 11, wherein the player who exceeds wins the amount of the player's wager.

18. The method of claim 11, wherein the player who exceeds 21 and ties the Dealer receives back the player's wager.

* * * * *